United States Patent [19]

Albrile

[11] 4,373,823

[45] Feb. 15, 1983

[54] RIBBON GUIDE FOR AN INKED RIBBON CARTRIDGE

[75] Inventor: Walter Albrile, Turin, Italy

[73] Assignee: Ing. C. Olivetti & C. S.p.A., Ivrea, Italy

[21] Appl. No.: 132,395

[22] Filed: Mar. 20, 1980

[30] Foreign Application Priority Data

Mar. 22, 1979 [IT] Italy ..... 67590 A/79

[51] Int. Cl.[3] ..... B41J 33/10

[52] U.S. Cl. ..... 400/196.1; 400/211; 400/223; 400/248; 400/440.2

[58] Field of Search ..... 400/194, 195, 196, 196.1, 400/208, 248

[56] References Cited

U.S. PATENT DOCUMENTS

| | | | |
|---|---|---|---|
| 2,803,331 | 8/1957 | Berill | 400/248 X |
| 3,897,866 | 8/1975 | Mueller | 400/196.1 X |
| 3,897,867 | 8/1975 | Shattuck et al. | 400/248 X |
| 3,994,383 | 11/1976 | Best | 400/196.1 |
| 4,046,247 | 9/1977 | Laspesa et al. | 400/196 |
| 4,157,224 | 6/1979 | Purzycki et al. | 400/196 X |

FOREIGN PATENT DOCUMENTS

| | | | |
|---|---|---|---|
| 2550305 | 5/1977 | Fed. Rep. of Germany | 400/196.1 |

*Primary Examiner*—Ernest T. Wright, Jr.
*Attorney, Agent, or Firm*—Schuyler, Banner, Birch, McKie & Beckett

[57] ABSTRACT

A cartridge for an inked ribbon for type bar typewriters comprises a container adapted to be mounted on one side of the printing point and a terminal part which guides a length of ribbon to the printing point and reverses the direction thereof for reentry of the ribbon into the container. Two return surfaces of the terminal part carry the ribbon reentering the container back at the same height as the emerging ribbon. The container is of elongated shape and is mounted removably on a support on the machine which rocks in front of a platen in such manner that the terminal part of the cartridge is disposed below the printing line. There is provided a mechanism for actuating the inked ribbon which comprises a control element actuatable by the type bars and a toggle joint which rock the cartridge support for effecting a precise raising of the ribbon in response to variable stroke control actuated by the selected key. A control pin is rotatable on the support and is actuated by the control element to engage vertically a driving hub of the cartridge and feeds the inked ribbon in front of the printing point.

12 Claims, 5 Drawing Figures

RIBBON GUIDE FOR AN INKED RIBBON CARTRIDGE

BACKGROUND OF THE INVENTION

The present invention relates to a cartridge for an inked ribbon for typewriters, comprising a container adapted to be mounted on one side of the printing point and a terminal part which guides a length of ribbon up to the printing point and reverses the direction thereof for reentry of the ribbon into the container.

Cartridges of the above-described kind for typewriters of the hammer type are known wherein the reversed ribbon reenters the container below the emerging ribbon. This necessitates the use of a container of twice the height with respect to the height of the ribbon. In typical use, the cartridge is disposed above the hammer basket and the height of the body of the machine must therefore be dimensioned to take account of the greater height of the cartridge. This drawback is particularly serious in the case of typewriters of portable type.

SUMMARY OF THE INVENTION

The object of the present invention is to provide an inked ribbon cartridge which can be arranged on one side of the printing point and the height of which is comparable with that of the ribbon.

In the event of a cartridge using an inked ribbon closed in the form of a loop, another object of the invention is to obtain a feed of the ribbon with minimum friction and which does not cause a piling-up of ribbon inside the said cartridge.

Another object of the invention is to provide an accurate mechanism for raising the ribbon which, within certain limits, is independent of the stroke of the element controlling the said raising.

A further object of the invention is to provide a manually operated typewriter in which the raising and feed of the ribbon affect the actuation of the typing keys to the minimum.

Finally, an additional object of the invention is to provide a typewriter in which the cartridge for the inked ribbon can be replaced with great ease and reliability.

The above-defined objects are achieved by the cartridge of the present invention, which is characterised by two return surfaces of the terminal part of the cartridge which carry the ribbon reentering the container of the cartridge back at the same height as the emerging ribbon.

The ribbon closed in the form of a loop is received in random fashion in a magazine of elongated shape which, at its two opposite ends, is provided respectively with a pair of rollers for feeding or advancing the ribbon and introducing it into a median zone of the magazine, and with friction means for tensioning the ribbon in the striking zone.

The raising of the ribbon takes place by means of a toggle joint which produces a precise raising of the ribbon in response to a variable stroke control actuated by the selected character.

The keys of the machine are restored by corresponding leaf springs having an end fixed on a base of the machine and the raising and feed of the inked ribbon are carried out by a universal frame which cooperates with the leaf springs in an intermediate zone between the fixed end and the zone of cooperation with the keys. The universal frame is moreover kept in contact with the leaf springs by the action of a corresponding element equipped with a spring.

Finally, the cartridge can be mounted on a support which rocks about a spindle perpendicular to the striking plane and on which is mounted a feed control pin engageable vertically by a driving hub of the cartridge and rotated conjointly with the rocking of the cartridge support.

BRIEF DESCRIPTION OF THE DRAWING

These characteristics and other characteristics of the invention will become clear from the following description of a preferred embodiment given by way of example, but non-limitatively, and from the accompanying drawing, in which.

DESCRIPTION OF THE PREFERRED EMBODIMENT

Figure 1:
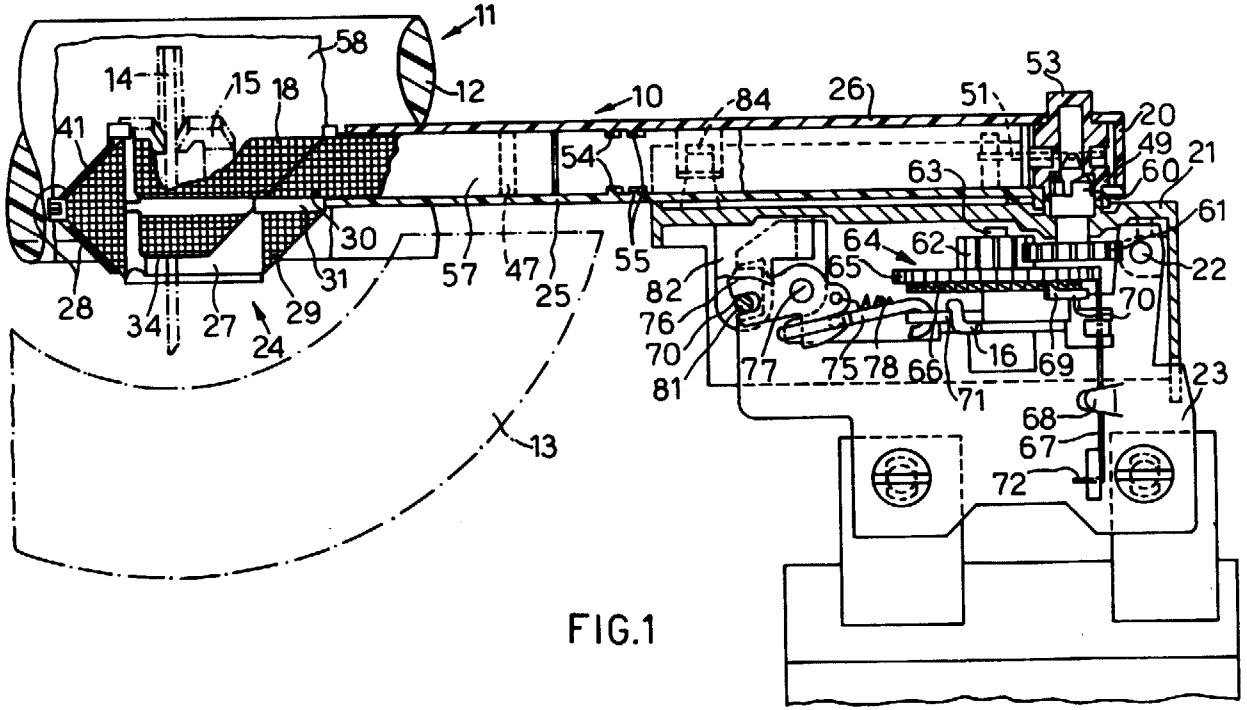
FIG. 1 is a partial front view of a typewriter comprising the cartridge and the ribbon actuating mechanism according to the invention.

The inked ribbon cartridge, indicated generally by the reference 10 (FIG. 1), is used on a typewriter 11 of the portable manual type.

The typewriter 11 comprises a platen 12, a basket 13 which bears type bars 14 and a fork 15 disposed in front of the striking point for guiding the selected type bar 14. A push rod 16 is actuated by each of the selected type bars 14 for raising and feeding the ribbon 18.

The cartridge 10 comprises a container 20 of plastic and of elongated shape for the ribbon 18, the container 20 being mounted on a support 21 rockable about a spindle 22 fixed to the frame 23 of the machine. From one end of the container 20 there projects a terminal part 24 which guides the ribbon 18 emerging from the container 20. The length of ribbon 18 which can be used for the striking operation is held tensioned in front of the printing point between the fork 15 and the platen 12 parallel to the said platen 12.

According to the invention, the distance between the bottom 25 of the container 20 and the cover 26 is little greater than the height of the ribbon 18. The terminal part 24 comprises a mounting rod 57 internal to the container 20 and a plate 27 in one piece with the rod 57. The plate 27 is disposed parallel to the striking plane and is provided with two edges 28 arranged in the form of a V at an angle of 90° and the surfaces of which reverse the direction of the ribbon 18 disposed beyond the printing point through 180°. The reverse length of ribbon 18 is held below the printing point in the same plane as the length of ribbon 18 emerging from the container 20. The terminal part 24 is provided with two return surfaces 29 and 30 which carry the ribbon 18 reversed by the edges 28 back first upwardly and then horizontally.

More particularly, the surface 29 is constituted by another edge of the plate 27 inclined at 45° with respect to the bottom 25 of the container so as to carry the ribbon 18 upwardly, turning it through 90° with respect to its direction of advance. The second surface 30 (see also FIGS. 2 and 3) is constituted by the edge of a second plate 31, this edge being parallel to the edge 29 and carrying the ribbon 18 at the same height as, and in front of, the ribbon 18 emerging from the container 20. The plate 31 is in one piece with the rod 57 and parallel with the plate 27. On its face directed towards the plate 27 the plate 31 moreover defines a channel for the passage of the upwardly turned ribbon 18, while at its outer face it defines a slit 33 with a front wall 32 of the container 20.

The plate 27 is provided with a window 34, defined by a vertical edge and by an edge at 45°, to leave the length of ribbon 18 disposed behind the fork 15 exposed to the striking of the type bar 14. A plate 35, which is also of plastics material, is moreover fixed by means of a pair of hooks 36 and spacers 17 between a pair of notches 19 arranged on the vertex of the V and on the vertical edge of the window 34, respectively, to prevent contact of the ribbon 18 with a sheet 58 to be typed on beyond the striking zone of the type bar 14.

Figure 2:
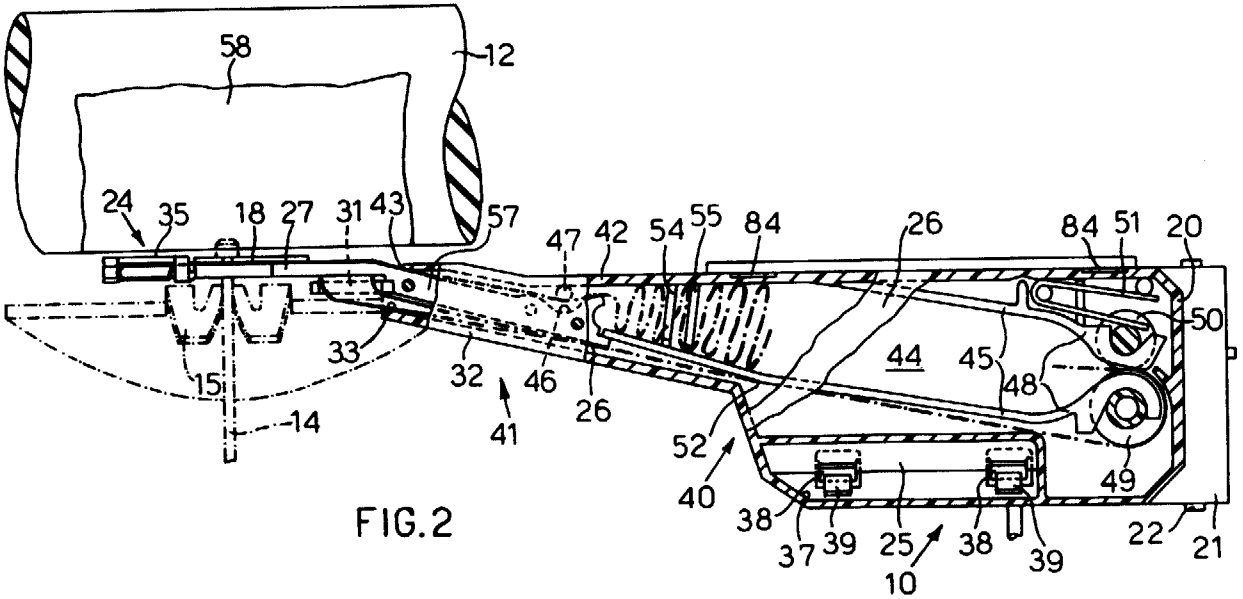
FIG. 2 is a partial plan view of the cartridge and the mechanism of FIG. 1.
Figure 3:
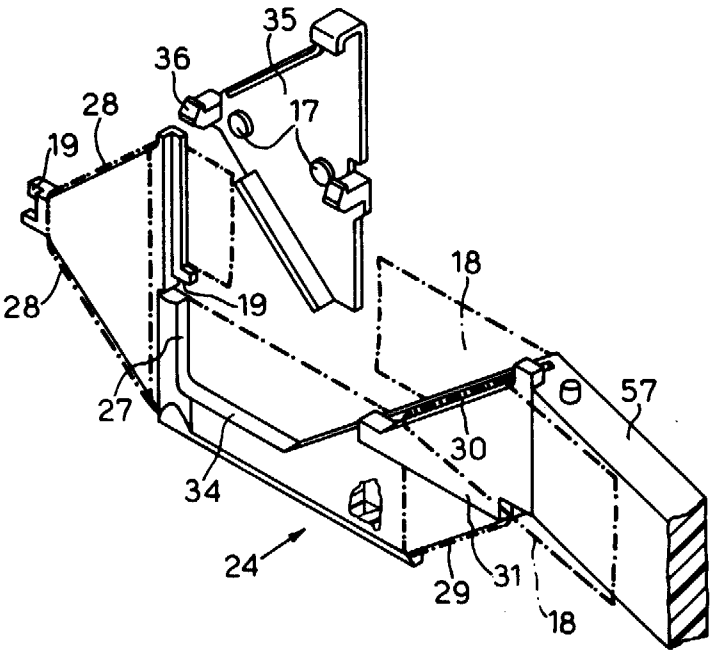
FIG. 3 is an exploded detail in perspective of the cartridge of FIG. 1.

Referring to FIG. 2, the container 20 for the ribbon 18 comprises a substantially parallelepipedal body 40 and an arm 41 provided with a rear wall 42 substantially in line with and forming an extension of one side of the body 40, and with the wall 32 which converges from the body 40 towards the plate 27.

The container 20 can be secured removably to the rocking support 21 by means of two teeth 38 projecting from the bottom 25 and engageable with two lugs 39 on the support 21, these in their turn extending with a clearance through an aperture 37 in the bottom 25. The plate 27 is fixed so that it overhangs with respect to the wall 42. The rod 57 is fitted between the bottom 25 and the cover 26 on the arm 41 and defines a slit 43 with the wall 42 for the exit of the ribbon 18 from the container 20.

The ribbon 18 is endless and its internal portion is contained in a random state in a magazine 44 of elongated shape disposed between a diagonal of the body 40 and the arm 41. The 180° deviation of the inked ribbon 18 (FIG. 1) caused by the edges 28 defines a Möbius configuration on the ribbon 18 which is not modified by the edges 29 and 30. The bends of ribbon 18 remain localized on the terminal part 24 by the precise guides represented by the edges 28, 29 and 30, the plate 35 (FIG. 3), the slits 33 and 43, and the bottom wall 25 and cover wall 26 of the container 20. The magazine 44 is defined by two side walls 45, which are substantially parallel to each other, and by a portion of the wall 42. At the end of the magazine 44, close to the slit 43, there is arranged a pair of elements exerting a friction on the ribbon 18 and comprising a V-shaped groove 46 formed on mounting rod 57 and a pin 47 fixed between the cover wall 26 and the bottom wall 25. At the other end, the magazine 44 is provided with two radiused surfaces 48 converging towards a median zone between the walls 45. In this zone, the ribbon 18 is in engagement with a driving roller 49 and a pressure roller 50 where the roller 50 is urged against the roller 49 by means of a hairpin spring 51. Finally, the driving roller 49 is provided with a knob 53 (FIG. 1) projecting from a hole in the cover 26 for facilitating the tensioning of the ribbon 18 in the terminal part 24 when the cartridge 10 is removed from the machine.

The feed of the ribbon 18 takes place through the slit 43 (FIG. 2) after its passage through the pair of friction-exerting elements 46, 47. The ribbon 18 then passes in front of the window 34 (FIG. 1), is reversed and is carried downwardly by the edges 28. From here the surfaces 29 and 30 of the plates 27 and 31 bring the ribbon 18 back to its original height. From the edge 30 and through the slit 33 (FIG. 2), the ribbon 18 is guided between the front wall 32 and a bend 52 of one of the walls 45 and is wound over about 180° around the driving roller 49 for entry into the magazine 44. The elongated structure of the magazine 44 and the arrangement of the rollers 49 and 50 in its median zone render the sliding of the ribbon 18 easy without zones in which there is excessive piling-up of the coils. Two pairs of steps 54 and 55 projecting from the bottom 25 and the cover 26 (FIG. 1) of the container 20 contribute towards reducing the coil density in the zone of withdrawal of the ribbon 18.

Figure 5:
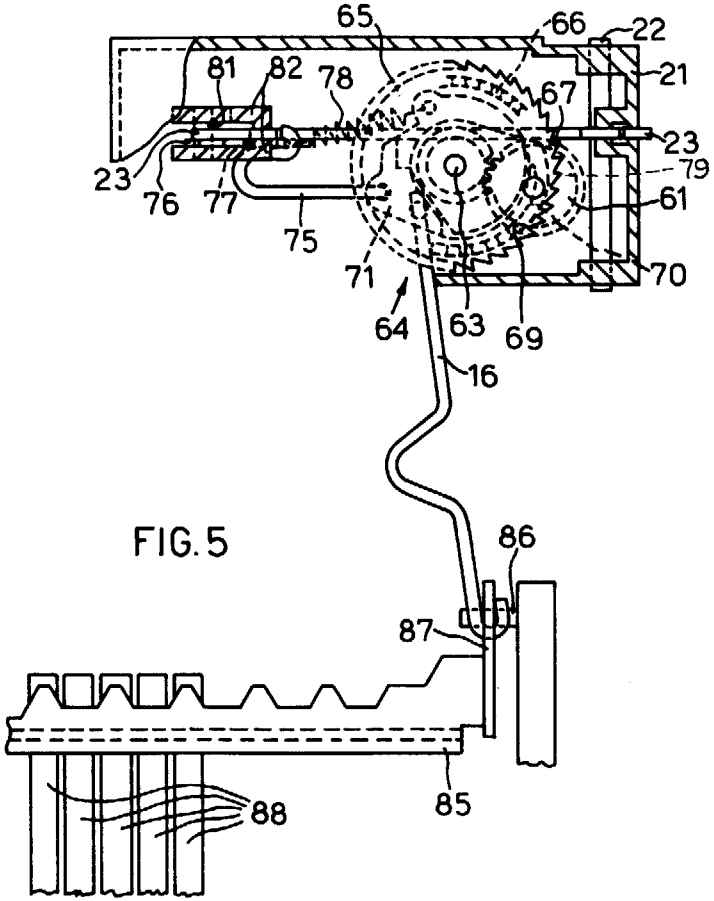
FIG. 5 is a plan view of the mechanism of FIG. 1.

From the top of the rocking support 21 of the machine there projects a driving pin 60 adapted to engage the roller 49 of the cartridge 10. On the pin 60, in the lower part of the support 21 and in the proximity of the spindle 22, there is keyed a toothed wheel 61 which is in mesh with a pinion 62 rotatable on a pin 63 fixed to the frame 23. Fixed to the pinion 62 is a wheel 64 provided with a peripheral toothing 65 and, on the surface opposite that where the pinion 62 is located, with a frontal toothing 66, both toothings 65 and 66 being of the saw-tooth type. The toothing 65 is in engagement with a countermotion spring constituted by a vertical wire 67 guided in an intermediate overhanging portion by a lug 68 of the frame 23 and provided with an L-shaped end 72 fixed to the said frame 23. The frontal toothing 66 is engaged resiliently by a tooth or dog 69 fixed to a flexible strip 70 (FIG. 5) carried by a lever 71. The lever 71 swings about the pin 63 and is pivotally connected to the control push rod 16.

Also pivoted to the lever 71 is a connecting rod 75, pivoted in turn to a crank 76 which can turn on a pin 77 on the frame 23 so as to form a toggle joint. A spring 78 is tensioned between the crank 76 and the lever 71 in such manner that a projection 79 of the strip 70 is arrested against the frame 23 and the axis of the spring 78 (FIG. 1) is coplanar with the pin 77. The crank 76 is connected through the medium of a slot 80 with a pin 81 fixed between two U-shaped arms 82 of the rocking support 21. These arms 82 embrace the frame 23 and guide the support 21 exactly during its rocking about the spindle 22.

Figure 4:
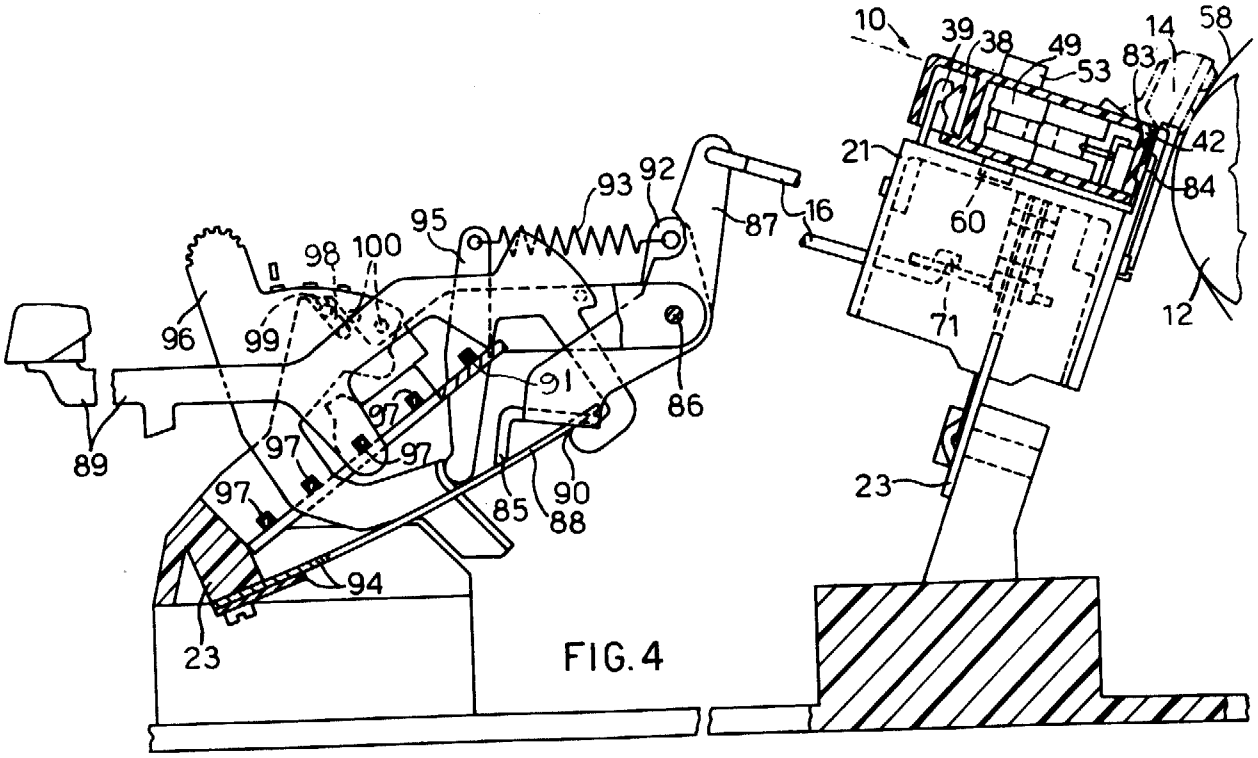
FIG. 4 is a side view of the parts of FIG. 1 from the right.

The typewriter (FIG. 4) comprises keys 89 which are pivoted on four rows of corresponding wire fulcrums 97 for actuating the type bars 14 while push rod 16 (FIG. 5) is pivoted to an arm 87 of a universal frame 85 rocking on transverse pins 86 and cooperating with a series of leaf springs 88 for restoring the keys 89 (FIG. 4). To this end, each leaf spring 88 cooperates with a lower shoulder 90 of each key 89. A spring 93 is attached to another arm 92 of the universal frame 85 and keeps the universal frame 85 in contact with the springs 88 in an intermediate zone between the zone of contact with the keys 89 and a zone 94 where the springs 88 are fixed to the frame 23. The other end of the spring 93 is attached to a lever 95 rocking about a pivot 91 cooperating with a knob 96 pivoted on the fulcrum 97 of the second row of the fulcrum wires of the keys 89. The knob 96 is of plastics material and is provided with a plurality of holes 100 adapted to be engaged by a small ball 99 on a flexible tongue 98 of the frame 23 to locate the knob 96 in a stable manner. In this way the load of the universal frame 85 on the springs 88 is varied, altering the "touch" of the keys 89.

In use, the cartridge 10 is fixed to the support 21 by means of the teeth 38 which, acting on the lugs 39, urge two recesses 83 in the side wall 42 against a pair of teeth 84 on the support 21 in such manner as to maintain the terminal part 24 (FIG. 2) in a preset intermediate position between the platen 12 and the fork 15. At the same time, the pin 60 of the machine engages the hollow part of the driving roller 49 of the cartridge 10 (FIG. 4).

Actuation of any one of the keys 89 causes upward bending of the corresponding spring 88 and clockwise rotation of the universal frame 85. This produces a backward movement of the push rod 16 (FIG. 5) and clockwise rotation of the tooth 69, which takes the teeth of the toothing 66 along with it. The wire 67 jumps over the toothing 65, while the toothed wheel 61 is rotated anticlockwise for the feed of the ribbon 18 by means of the driving pin 60 (FIG. 1). Because of the rotation of the lever 71, the connecting rod 75 causes the crank 76 to turn clockwise in opposition to the action of the spring 78 and the terminal part 24 of the cartridge 10 rises until it brings the ribbon 18 in front of the striking point. In response to the working stroke of the push rod 16 (FIG. 5), the pivots of the connecting rod 75 on the crank 76 and the lever 71 become substantially coplanar with the axis of the pin 63. This ensures rotation of the crank 76 and, therefore, a raising of the ribbon 18 which are substantially constant, even in the case of variable working strokes of the push rod 16 which are due to the particular type bar 14 selected. The closeness of the meshing zone between the pinion 62 and the toothed wheel 61 causes their engagement not be lost during the rocking of the support 21.

When the selected type bar 14 moves back, the push rod 16 also returns to the inoperative position under the action of the spring 93 (FIG. 4). The spring 78 (FIG. 5) then causes both the lever 71 and the crank 76 to turn anticlockwise, while the wheel 64 remains stationary through the action of the wire 67 on the toothing 65. The crank 76 brings the pin 81 and, therefore, the ribbon 18 downward and allows the operator to see the printed character.

According to the stroke of the push rod 16, the feed of the ribbon 18 will correspond to a rotation of two or three teeth of the toothing 66, but this has no effect for the purposes of distinctness of the character to be printed, nor for the purposes of raising the ribbon 18.

I claim:

1. A cartridge for an inked ribbon for a typewriter of the type comprising a platen including a printing point, type bars individually selectable to strike the printing point, and a support for said cartridge pivoted on an axis substantially perpendicular to said platen for raising the cartridge, wherein said cartridge comprises a container mountable on said support which stores internally the inked ribbon and includes a bottom wall, a cover spaced from the bottom wall a little more than the height of the inked ribbon and two side walls converging toward a narrow area; and a terminal member projecting from the narrow area of the cartridge for guiding a length of the inked ribbon to the exterior of the container from a side of said narrow area to be struck by a selected type bar and to re-enter the container at the same height as that of the internal inking ribbon; wherein said terminal member comprises:

a fixed end mounted on said container and which defines together with said two side walls of the container an entrance slit and an exit slit for the inked ribbon;

a free end opposite to the fixed end and which includes two converging edges;

an intermediate thin portion connected between the fixed end and the free end and which includes a window and a part lying below said window and the bottom wall of the container, said intermediate portion having an inclined edge; and a further thin portion projecting from said fixed end which defines a gap between said further thin portion and said intermediate thin portion, said further thin portion including a re-entering edge;

wherein said converging edges guide a portion of said length of inked ribbon along a path which comprises a first part wherein the inked ribbon emerges from the exit slit and crosses the window and a second part wherein the inked ribbon lies in front of said part of said intermediate thin portion and below the first part of said path;

wherein the inclined edge of said intermediate thin portion defines an upward path of the inked ribbon which is bent upwardly with respect to the direction of the second part of said path wherein a part of said inked ribbon is confined in said gap between said further thin portion and said intermediate thin portion;

wherein the re-entering edge of said further thin portion defines a lateral path of the inked ribbon which is bent laterally with respect to the direction of said upward path of the ribbon and wherein the ribbon reenters said container at the same height of the internal ribbon; and wherein the intermediate thin portion of said terminal member is configured to lie generally parallel to said platen when the cartridge is mounted on its support and to cause the ribbon crossing said window to be positioned in front of the printing point upon the raising of the cartridge and the window to freely accommodate the striking type bar.

2. A cartridge according to claim 1, wherein the inclined edge of said intermediate thin portion and the re-entering edge of said further thin portion are substantially parallel and inclined at 45° with respect to the direction of the first part of the path of said length of the inked ribbon.

3. A cartridge according to claim 1, wherein said terminal member comprises a plate whereon said converging edges and said thin intermediate part are provided.

4. A cartridge according to claim 1, wherein said further thin portion is in one piece with said fixed end of said terminal member.

5. A cartridge according to claim 1, wherein said container comprises two parts wherein a first part comprises the bottom wall and a second part comprises the cover and wherein said fixed end of said terminal member comprises an element fitted between the bottom wall and the cover of said container.

6. A cartridge according to claim 1, wherein a typewriter on which the cartridge is mountable includes a type bar guiding fork for a selected type bar, wherein said container is of elongated shape and is directly mounted on the support of the cartridge and wherein only said part of said intermediate portion of said terminal member is disposed below the printing line between said type bar guiding fork and the platen.

7. A cartridge according to claim 1, wherein said container comprises a magazine of elongated shape which receives the ribbon in a random state, wherein said magazine at its two opposite ends, is provided respectively with a pair of rollers disposed in a median zone of the magazine for feeding the ribbon and introducing the ribbon into the said median zone, and with friction means for tensioning the ribbon in a striking zone thereof during the feed of said ribbon caused by said rollers.

8. A cartridge according to claim 1, wherein the support of said cartridge of the typewriter has a rectangular base provided with two vertical teeth adjacent to the platen and two lugs displaced from the platen, wherein the container comprises two recesses on one of said side walls, an opening on said bottom wall and two teeth projecting from the bottom wall toward the cover wall inside said opening, wherein, in use, the vertical teeth of the support for said cartridge cooperate with said two recesses and wherein said two lugs enter in said opening and cooperate with the two teeth of said container for locating the thin portions of said terminal member parallel to the platen of the typewriter.

9. A ribbon guide for an inked ribbon cartridge of type bar typewriters, wherein the cartridge comprises an inked ribbon, a container which stores internally the inked ribbon and includes a bottom wall, a cover spaced from the bottom wall a little more than the height of the inked ribbon and a rear wall and wherein said ribbon guide guides an external length of the inked ribbon to emerge from the container up to a printable area and from the printable area to re-enter the container at the same height as that of the emerging ribbon, said ribbon guide comprising:

a fixed end secured to said container;

a first plate member substantially parallel to the rear wall of said container and provided with a window for the inked ribbon, wherein said plate member comprises a part lying below the bottom wall of the container and including an inclined edge;

a free end including two converging edges wherein one edge of said converging edges guides the external length of the inked ribbon along a transversal upper section which starts from the container and crosses said window to said one edge to define the printable area of said inked ribbon and wherein another of said converging edges guides the external length of the inked ribbon along a transversal lower section which starts from said other edge to said inclined edge of said first plate member and wherein the transversal lower section of the inked ribbon lies below said transversal upper section;

a second plate member located adjacent to the container which defines a channel with respect to said first plate member, wherein said channel lies between said window and said container, wherein said second plate member includes a re-entering edge lying above said inclined edge of said first plate member;

wherein said inclined edge of said first plate member bends upwardly an upward section of the external length of the inked ribbon towards the re-entering edge of said second plate member and confines said upward section of inked ribbon in said channel; and wherein said re-entering edge bends laterally a lateral section of the external length of the inked ribbon and causes said lateral section to re-enter the container at the same height of the transversal upper section of the external length of the inked ribbon.

10. A ribbon guide according to claim 9, wherein said window is defined by a first edge of said first plate member substantially perpendicular to the bottom wall of the container, by a second edge substantially parallel to said inclined edge and by a third edge parallel to said bottom wall.

11. A ribbon guide according to claim 9, wherein said window is delimited by a vertical edge of said first plate member having a notch, wherein said converging edges start from a common vertex having another notch, further comprising a protective plate protecting the inked ribbon adjacent to said converging edges which is fixed to said free end by means of two hooks of said protective plate which cooperate with the notch of said vertical edge and the notch of said common vertex.

12. A cartridge according to claim 9, wherein said container comprises a body of parallelepipedal form delimited by said rear wall and ending with a lateral projection, wherein said lateral projection is delimited by the rear wall of the container and by a front wall converging toward said rear wall and connected with the body of the cartridge, wherein the fixed end of said ribbon guide is internal to the container and defines two slits with said front wall and said rear wall for the passage of the inked ribbon, wherein said window is laterally defined by a window edge parallel to the inclined edge of said first plate member and wherein said window edge and said inclined edge are adjacent to one of said slits and said re-entering edge is adjacent to the other of said slits.

* * * * *